US008918313B2

(12) United States Patent
Ookuri et al.

(10) Patent No.: US 8,918,313 B2
(45) Date of Patent: Dec. 23, 2014

(54) REPLAY APPARATUS, SIGNAL PROCESSING APPARATUS, AND SIGNAL PROCESSING METHOD

(75) Inventors: Kazunobu Ookuri, Kanagawa (JP); Kohei Asada, Kanagawa (JP); Yasunobu Murata, Tokyo (JP)

(73) Assignee: Sony Corporation, Tokyo (JP)

( * ) Notice: Subject to any disclaimer, the term of this patent is extended or adjusted under 35 U.S.C. 154(b) by 409 days.

(21) Appl. No.: 13/472,617

(22) Filed: May 16, 2012

(65) Prior Publication Data

US 2012/0310636 A1 Dec. 6, 2012

(30) Foreign Application Priority Data

Jun. 6, 2011 (JP) ..... 2011-125949

(51) Int. Cl.

| | |
|---|---|
| ***G10L 21/02*** | (2013.01) |
| ***G10L 13/00*** | (2006.01) |
| ***G10L 21/00*** | (2013.01) |
| ***G10K 11/178*** | (2006.01) |

(52) U.S. Cl.

CPC ..... *G10K 11/1786* (2013.01)
USPC ..... 704/226; 704/260; 704/270; 704/270.1; 704/275; 704/258

(58) Field of Classification Search

USPC ..... 704/226, 258, 260, 270, 270.1, 275, 704/276, 277, 278
See application file for complete search history.

(56) References Cited

U.S. PATENT DOCUMENTS

| | | | | |
|---|---|---|---|---|
| 5,773,744 | A * | 6/1998 | Nagata | 84/610 |
| 6,702,584 | B2 * | 3/2004 | Ueshima et al. | 434/307 A |
| 6,940,982 | B1 | 9/2005 | Watkins | |
| 7,244,885 | B2 * | 7/2007 | Kageyama | 84/645 |
| 7,525,033 | B2 * | 4/2009 | Lance | 84/477 R |
| 8,538,749 | B2 * | 9/2013 | Visser et al. | 704/228 |
| 2006/0288851 | A1 * | 12/2006 | Kawamura et al. | 84/624 |
| 2007/0186755 | A1 * | 8/2007 | Lance | 84/611 |
| 2008/0215651 | A1 * | 9/2008 | Sawada et al. | 708/205 |
| 2009/0105859 | A1 * | 4/2009 | Tagawa et al. | 700/94 |
| 2009/0147969 | A1 | 6/2009 | Kinouchi et al. | |
| 2012/0308022 | A1 | 12/2012 | Ookuri et al. | |
| 2013/0013303 | A1 * | 1/2013 | Strommer et al. | 704/226 |
| 2013/0205243 | A1 * | 8/2013 | Rivera et al. | 715/776 |

FOREIGN PATENT DOCUMENTS

| | | | |
|---|---|---|---|
| JP | 2001-034277 | A | 2/2001 |
| WO | WO 2011/020992 | A2 | 2/2011 |

* cited by examiner

*Primary Examiner* — Edgar Guerra-Erazo

(74) *Attorney, Agent, or Firm* — Wolf, Greenfield & Sacks, P.C.

(57) ABSTRACT

A method of selectively performing signal processing in a first mode and in a second mode. In the first mode, a noise cancel signal having a signal characteristic to cancel an external noise component is generated based on a voice signal supplied from a microphone, and an input digital audio signal and the noise cancel signal are combined into a voice signal to be output through a speaker. In the second mode, a sound process for vocal voice is performed on a voice signal supplied from a microphone, a vocal voice component is canceled from a digital audio signal of input music to generate a karaoke signal, and the karaoke signal and the vocal signal are combined into a voice signal to be output through a speaker. The first mode corresponds to an audio replay operation accompanied by noise cancel, and the second mode corresponds to a karaoke operation.

10 Claims, 14 Drawing Sheets

REPLAY APPARATUS, SIGNAL PROCESSING APPARATUS, AND SIGNAL PROCESSING METHOD

BACKGROUND

The present disclosure relates to a replay apparatus, a signal processing apparatus, and a signal processing method and, more particularly, to a technology for selectively performing a music replay operation and a karaoke operation.

PRIOR ART

Patent Document

[Patent document 1] Patent Application Publication No. 2001-34277

A lot of general users enjoy the benefits of listening to music by means of portable audio players. It is well known that an audio player including an earphone equipped with a microphone may allow users to enjoy listening to music with less noise in a noisy situation by obtaining a signal of an opposite phase to that of an external noise signal collected through the microphone and adding the obtained signal to an audio signal. In addition, a lot of general users may be entertained with karaoke.

SUMMARY

A portable audio player and a karaoke system are completely different from each other. Accordingly, such a place as home has to be equipped with a karaoke system for a user to enjoy karaoke. The present technology is conceived to provide a replay apparatus, such as a portable audio player, which enables users to conveniently enjoy karaoke at any time.

According to an embodiment of the present disclosure, there is provided a replay apparatus which includes a music source unit configured to output a digital audio signal of music; a microphone signal input unit configured to input a voice signal supplied from a microphone; a noise cancel signal generating unit configured to generate a noise cancel signal having a signal characteristic to cancel an external noise component based on the voice signal input by the microphone signal input unit; a vocal processing unit configured to perform a sound process for vocal voice on the voice signal input by the microphone signal input unit to generate a vocal signal; a karaoke signal generating unit configured to generate a karaoke signal by canceling a vocal voice component from the digital audio signal supplied from the music source unit; a combination unit configured to perform a first combining process where the digital audio signal supplied from the music source unit and the noise cancel signal are combined, and a second combining process where the karaoke signal and the vocal signal are combined; a control unit configured to control the combination unit to perform the first combining process in a first mode and to perform the second combining process in a second mode; and an output unit configured to output the combined signals combined by the combination unit as a voice signal to be output from a speaker. For example, the noise cancel signal generating unit, the vocal processing unit, the karaoke signal generating unit and the combination unit may be installed as software processing functions in an operation processing device. Further, the control unit may controls the operation processing device to execute the noise cancel signal generating unit and to execute the combination unit to perform the first combining process in the first mode, and the control unit may control the operation processing device to execute the vocal processing unit and the karaoke signal generating unit and to execute the combination unit to perform the second combining process in the second mode.

According to another embodiment of the present disclosure, there is provided a signal processing apparatus which includes a microphone signal input unit configured to input a voice signal supplied from a microphone; a noise cancel signal generating unit configured to generate a noise cancel signal having a signal characteristic to cancel an external noise component based on the voice signal input by the microphone signal input unit; a vocal processing unit configured to perform a sound process for vocal voice on the voice signal input by the microphone signal input unit to generate a vocal signal; a karaoke signal generating unit configured to generate a karaoke signal by canceling a vocal voice component from the digital audio signal of input music; a combination unit configured to perform a first combining process where the input digital audio signal and the noise cancel signal are combined, and a second combining process where the karaoke signal and the vocal signal are combined; a control unit configured to control the combination unit to perform the first combining process in a first mode and to perform the second combining process in a second mode; and an output unit configured to output the combined signals combined by the combination unit as a voice signal to be output from a speaker.

According to another embodiment of the present disclosure, there is provided a method of selectively performing signal processing in a first mode and in a second mode. Further, in the first mode, a noise cancel signal having a signal characteristic to cancel an external noise component is generated based on a voice signal supplied from a microphone, and an input digital audio signal and the noise cancel signal are combined into a voice signal to be output through a speaker; and in the second mode, a sound process for vocal voice is performed on a voice signal supplied from a microphone, a vocal voice component is canceled from a digital audio signal of input music to generate a karaoke signal, and the karaoke signal and the vocal signal are combined into a voice signal to be output through a speaker.

The present technology is conceived to provide a replay apparatus, such as a portable audio player, which enables such an operation processing device as a digital signal processor (DSP) configured to perform digital audio signal processing (particularly, noise cancel processing) to be converted to perform karaoke signal processing. Accordingly, a user may use the replay apparatus to listen to music in a first mode and to serve as a karaoke system in a second mode. Since such a configuration may only be accomplished by changing internal process of the operation processing device, no hardware has to be added. Further, a microphone with noise cancel function, such as a microphone installed in an earphone unit, may be used as a vocal microphone for karaoke. In addition, in the second mode for karaoke, the operation processing device may also perform a variety of sound processes for vocal voice.

EFFECTS OF THE INVENTION

The present technology enables users to use a replay apparatus to listen to music as well as to conveniently enjoy karaoke.

DETAILED DESCRIPTION OF THE EMBODIMENT(S)

Figure 1:
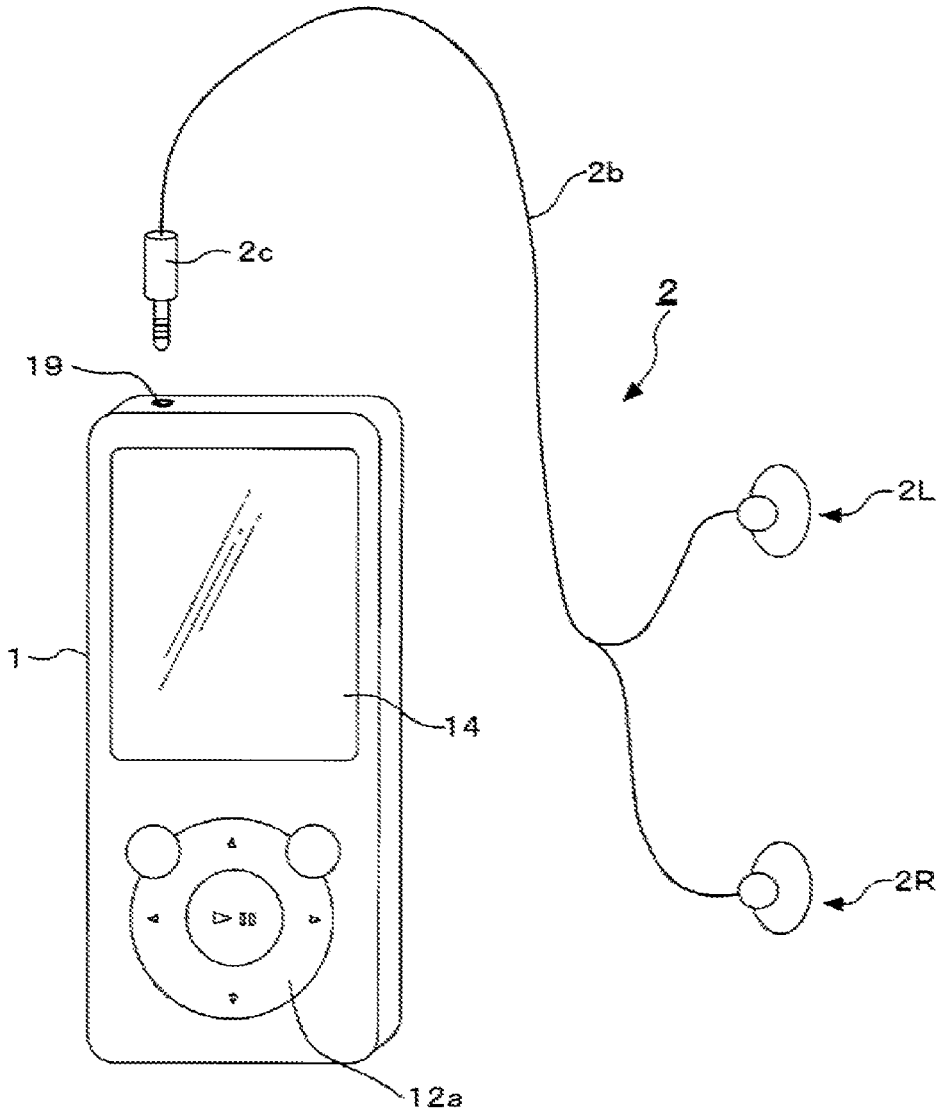
FIG. 1 is a view illustrating an audio player according to an exemplary embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Further, preferred embodiments of the present disclosure will be described in the following order. In the appended claims, a replay apparatus according to an embodiment of the present disclosure is a portable audio player, and a signal processing apparatus is incorporated in an audio player according to an embodiment of the present disclosure.

<1. Example of audio player operating in karaoke mode>

<2. Structure of audio player>

<3. Signal processing in NC mode and karaoke mode>

<4. Processing examples of DSP>

<5. Modified examples>

<1. Example of Audio Player Operating in Karaoke Mode>

A portable audio player according to an embodiment of the present disclosure may be used for a user to replay and enjoy music and may also be used as a karaoke system.

FIG. 1 is a view illustrating an audio player 1 according to an embodiment of the present disclosure. The audio player 1 includes a replay unit and a digital signal processor (DSP) for signal processing, which are encased in a small portable case, to output a voice signal. The audio player 1 further includes a display unit 14 and an operating part 12*a*. The audio player 1 is typically used with an earphone device 2. The earphone device 2 includes L- and R-channel speaker units 2L, 2R, a cord 2*b*, and a plug 2*c*. A user listens to music replayed from the audio player 1 by connecting the plug 2*c* of the earphone device 2 to a jack 19 of the audio player 1 and wearing the speaker units 2L, 2R inside his/her ears. The present embodiment illustrates an earphone which the user wears inside his/her ears. However, a headphone which the user wears over his/her ears may be used.

As described below, the speaker units 2L, 2R are equipped with microphones to collect external noises. The audio player 1 provides a user with a replayed voice with a reduced noise by generating a noise cancel signal based on a voice signal collected by the microphones and adding the noise cancel signal to an audio signal. In the present disclosure, "noise cancel" may be denoted by "NC."

The user may use the audio player 1 to enjoy karaoke in the following manner. FIG. 2A is a view illustrating the audio player 1 which is used by a user to implement a karaoke system by connecting the audio player 1 to an external amplifier 4. The audio player 1 has an external connection terminal (not shown) by which to connect to the amplifier 4. The amplifier 4 is connected to speakers 5, 5. In this case, a voice signal output from the audio player 1 is output as voice through the speakers 5, 5.

The user uses the microphones installed in the speaker units 2L, 2R of the earphone device 2, i.e., microphones, which are usually used to collect external noises, are used as vocal microphones. Further, the audio player 1 generates a karaoke signal from audio data of a replayed music by performing a vocal cancel process on the audio data of a replayed music. Further, the audio player 1 mixes the karaoke signal with a microphone input voice signal which is the voice of a singing user. The audio player 1 supplies the mixed voice signal to the amplifier 4. The mixed voice signal is output from the speakers 5, 5. As such, the user may sing to a music (karaoke music) from the external speakers 5, 5 and the singing voice may also be output from the speakers 5, 5, thereby implementing a karaoke system.

Instead of the microphone for noise collection of the earphone device 2 illustrated in FIG. 2A, for example, a mono microphone 3M illustrated in FIG. 2B or a stereo microphone 3S illustrated in FIG. 2C may be connected to the jack 19 of the audio player 1. In this case, the user may hold the audio player 1 and sing a song using the audio player 1 as a vocal microphone.

Figure 3:
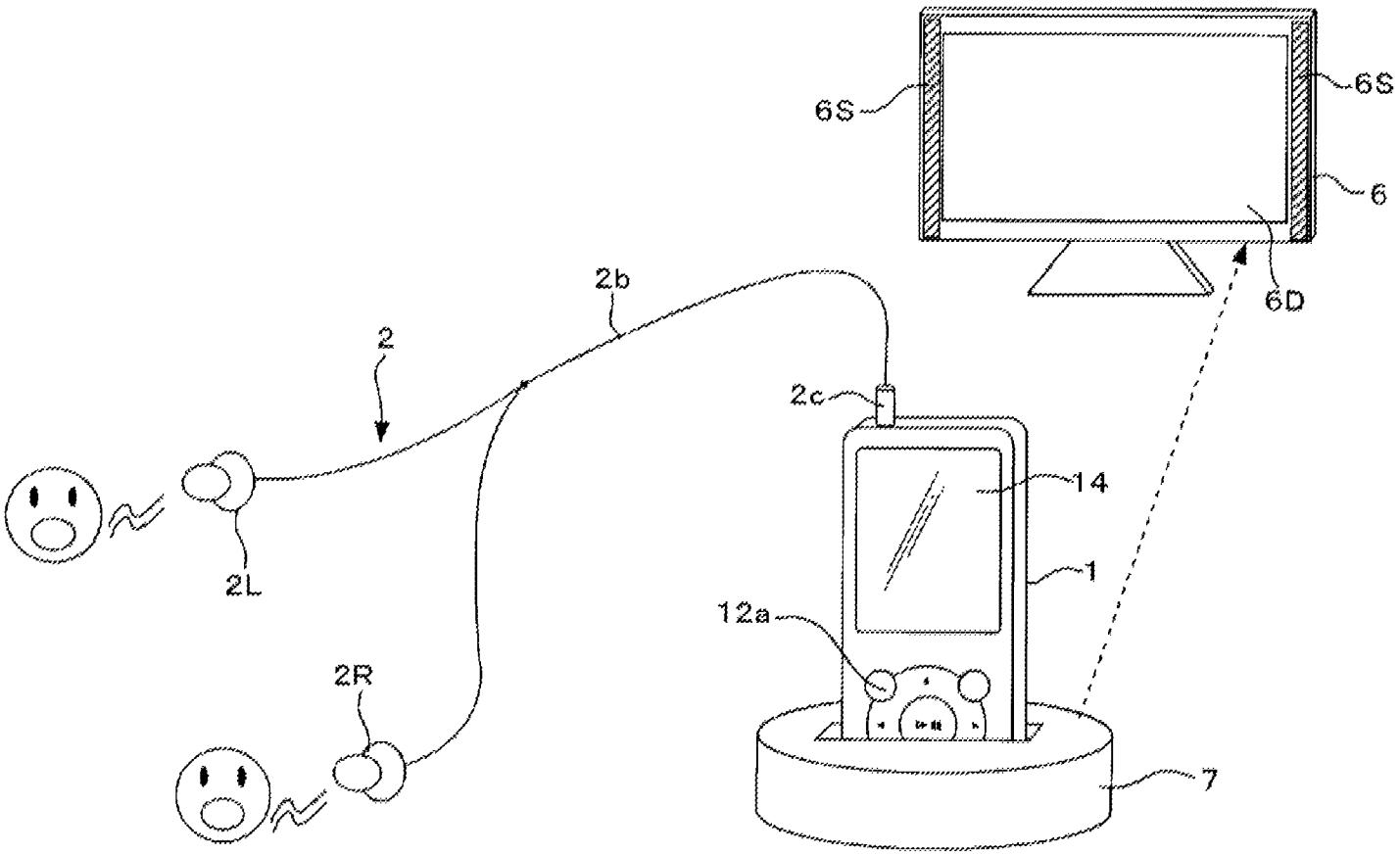
FIG. 3 is a view illustrating an audio player which is used to implement a karaoke system according to an exemplary embodiment of the present disclosure.

FIG. 3 is a view illustrating the audio player 1 which is used to implement a karaoke system by connecting the audio player 1 to the monitor 6 (e.g., television set or personal computer monitor). The monitor 6 is equipped with a display 6D and speakers 6S, 6S. In FIG. 3, the audio player 1 is mounted on a cradle 7 through which the monitor 6 is connected in wired or wireless manner for data communication. The audio player 1 supplies output audio data through the external connection terminal to the cradle 7. The cradle 7 transmits the audio data to the monitor 6. Further, the audio player 1 is connected to the earphone device 2 so that two users may use microphones for noise collection, which are installed in the speaker units 2L, 2R, as vocal microphones. While the earphone device 2 may be used for one user, the earphone device 2 may be used for two users singing a duet since the earphone device 2 is operated in stereo.

The audio player 1 generates a karaoke signal from audio data of a replayed music by performing a vocal cancel process on the audio data of a replayed music. Further, the audio player 1 mixes the karaoke signal with a microphone input voice signal, which is the voice of a singing user. The mixed voice signal is supplied to the monitor 6 through the cradle 7 and is output through the speakers 6S, 6S. As such, the user may sing to the music (i.e., karaoke music) from the speakers 6S, 6S of the monitor 6 and the user's singing voice may also be output from the speakers 6S, 6S, thereby implementing a karaoke system.

On the other hand, the audio player 1 may be equipped with a function of displaying lyrics which are accompanied by the replayed music. In this case, lyrics data corresponding to the audio data of the replayed music may also be configured to be supplied to the monitor 6. In this case, since the lyrics may be displayed on the display 6D of the monitor 6, this is suitable for the karaoke. Further, in FIGS. 2A and 2B, the lyrics may be displayed on the display unit 14 of the audio player 1.

Figure 4:
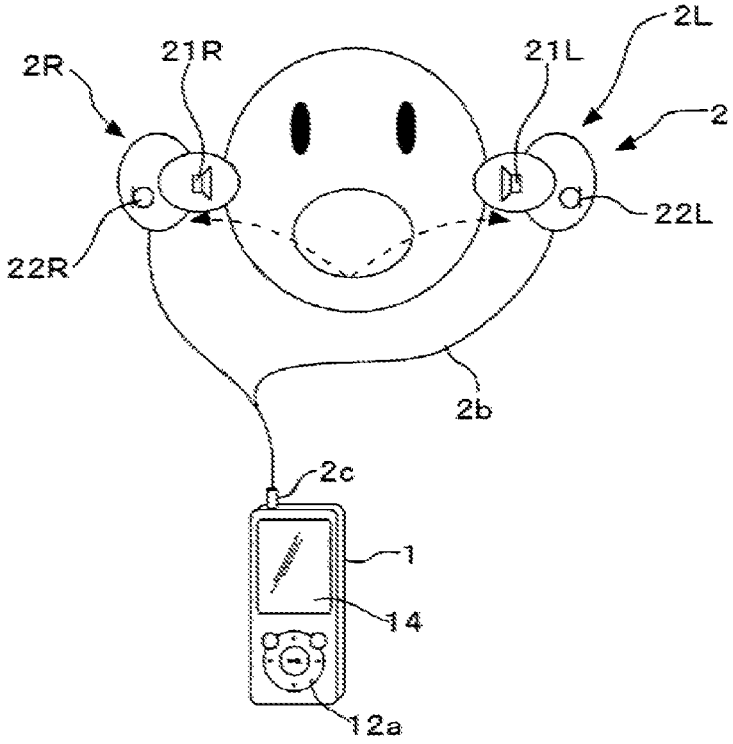
FIG. 4 is a view illustrating an audio player which is used to implement a karaoke system according to an exemplary embodiment of the present disclosure.

FIG. 4 is a view illustrating the audio player 1 and the earphone device 2 which are used to implement a karaoke system. The user may wear the speaker units 2L, 2R of the earphone device 2 so that he/she may listen to voice output from speakers 21L, 21R in the speaker units 2L, 2R. The speaker units 2L, 2R are equipped with microphones 22L, 22R for noise collection. The microphones 22L, 22R may be used as vocal microphones. In this case, while the vocal microphones are placed around the user's ears rather than around the user's mouth, the user's voice may be certainly collected by performing the following beamforming process on the audio player 1.

The audio player 1 generates a karaoke signal from audio data of a replayed music by performing a vocal cancel process on the audio data of a replayed music. Further, the audio player 1 mixes the karaoke signal with a voice signal input from the microphones 22L, 22R, which is the voice of a singing user. The mixed voice signal is output from the speakers 21L, 21R. As such, the user may listen to karaoke music with the earphone device 2 and sing to the karaoke music while listening to his/her singing voice with the earphone device 2, thereby simply implementing a karaoke system.

<2. Structure of Audio Player>

Figure 5:
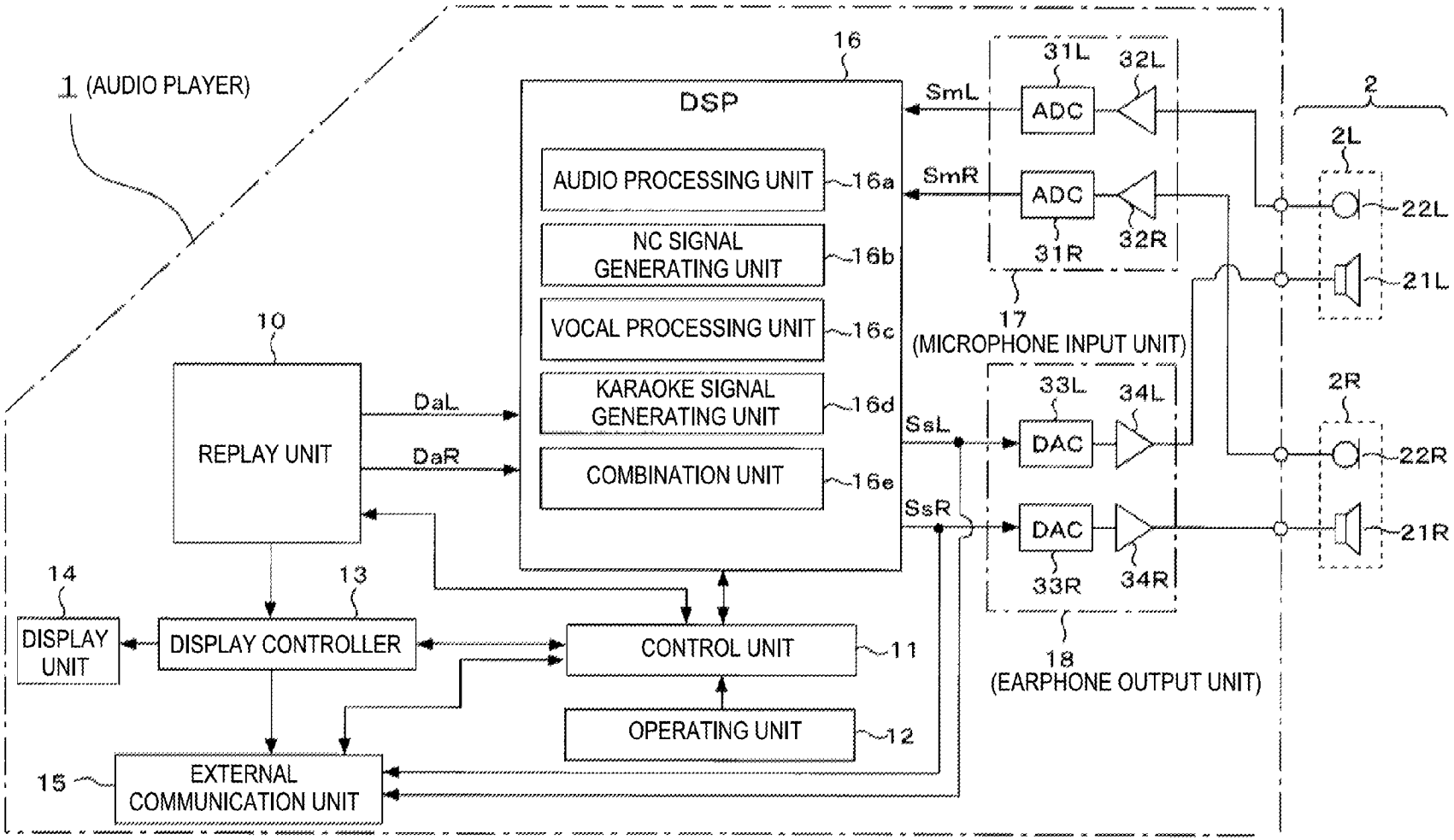
FIG. 5 is a block diagram illustrating an audio player according to an exemplary embodiment of the present disclosure.

A structure of the audio player 1 according to an embodiment of the present disclosure which may be used as a karaoke device in the above-mentioned manner will be described with reference to FIG. 5. FIG. 5 illustrates that the earphone device 2 is connected. The speaker units 2L, 2R of the earphone device 2 are equipped with the speakers as well as the microphones for external noise collection, as described above. That is, as shown in FIG. 5, the speaker unit 2L includes the speaker 21L and the microphone 22L, while the speaker unit 2R includes the speaker 21R and the microphone 22R. The earphone device 2 and the audio player 1 are electrically connected to each other as shown in FIG. 5 by the contact between the plug 2*c* and the jack 19 which are shown in FIG. 1.

As shown in FIG. 5, the audio player 1 includes a replay unit 10, a control unit 11, an operating unit 12, a display controller 13, a display unit 14, an external communication unit 15, a DSP 16, a microphone input unit 17, and an earphone output unit 18.

The replay unit 10 is a music source unit outputting a digital audio signal such as music. The replay unit 10 includes a recording medium for storing, for example, music content thereon, and a decoder for decoding data of the music content read from the recording medium. Examples of the recording medium may include solid-state memory, such as flash memory, and a hard disc drive (HDD). Further, instead of such a built-in recording medium, examples of the recording medium may include a drive corresponding to a removable recording medium, such as a memory card equipped with solid-state memory, an optical disc, such as a compact disc (CD) or a digital versatile disc (DVD), a magneto-optical disc, or hologram memory. It should be understood that both the built-in memory, such as solid-state memory or HDD, and the drive for the removable recording medium may be mounted on the replay unit 10. For example, such a recording medium has such data as music content encoded by a voice encoding technique. The replay unit 10 decodes the coded data of music content read from the recording medium and outputs digital audio signals DaL, DaR as, for example, L- and R-channel linear PCM data, to the DSP 16. The replay unit 10 may receive digital audio signals transmitted in wireless or wired manner from external devices, and output the digital audio signals DaL, DaR as L- and R-channel linear PCM data.

Voice signals collected by the microphones 22L, 22R of the earphone device 2 is input to the audio player 1 through the microphone input unit 17. The voice signal input through the microphone 22L is amplified by the microphone amplifier 32L and converted into a digital signal by the A/D converter 31L. The voice signal input through the microphone 22R is amplified by the microphone amplifier 32R and converted into a digital signal by the A/D converter 31R. The voice signals converted into the digital signals (hereinafter referred to as "microphone input signals SmL, SmR) are supplied to the DSP 16.

The DSP 16 performs appropriate operations on the digital audio signals DaL, DaR which are supplied from the replay unit 10. Further, the DSP 16 performs appropriate operations, such as noise cancel process, on the voice signals (microphone input signals SmL, SmR) which are input through the microphone input unit 17. The DSP 16, which is a processor implemented by software, includes an audio processing unit 16*a*, a noise cancel signal generating unit (hereinafter referred to as "NC signal generating unit") 16*b*, a vocal processing unit 16*c*, a karaoke signal generating unit 16*d*, and a combination unit 16*e*.

The audio processing unit 16*a* performs operations, such as equalization or gain adjustment, on the digital audio signals DaL, DaR to be output to the earphone device 2. The equalizing operation includes sound quality correction, such as amplitude-frequency characteristic correction and/or phase-frequency characteristic correction. The gain adjusting operation performs volume amplification or volume limitation for the digital audio signals DaL, DaR.

The NC signal generating unit 16*b* generates noise cancel signals, which have a signal characteristic of canceling external noise components, based on the microphone input signals SmL, SmR which are input from the microphone input unit 17. In other words, the NC signal generating unit 16*b* generates a signal of an opposite phase to that of an external noise component which is collected by the microphones 22L, 22R.

The vocal processing unit 16*c* processes the microphone input signals SmL, SmR input from the microphone input unit 17 into vocal signals by performing a sound process on the microphone input signals SmL, SmR to be suitable for vocals. The karaoke signal generating unit generates a karaoke signal with no or less vocal sound by canceling vocal voice components from the digital audio signals DaL, DaR. The combination unit 16*e* performs a first combining process to combine the digital audio signal processed by the audio processing unit 16*a* and the noise cancel signal generated by the NC signal generating unit 16*b*. Further, the combination unit 16*e* performs a second combining process to combine the karaoke signal generated by the karaoke signal generating unit 16*d* and the vocal signal from the vocal processing unit 16*c*.

The signals processed by the DSP 16, i.e., the signals combined by the combination unit 16*e* are supplied as the output signals SsL, SsR to the earphone output unit 18. The output signal SsL is converted into an analog signal by a D/A converter 33L, amplified by a power-up 34L, supplied to a speaker 21L and output as a sound. The output signal SsR is converted into an analog signal by a D/A converter 33R, amplified by a power-up 34R, supplied to a speaker 21R and output as a sound. That is, the earphone output unit 18 outputs the output signals SsL, SsR from the DSP 16 as voice signals to the speakers 21L, 21R. Further, the earphone output unit 18 may be configured to perform operations as digital amplifiers.

Figure 2:
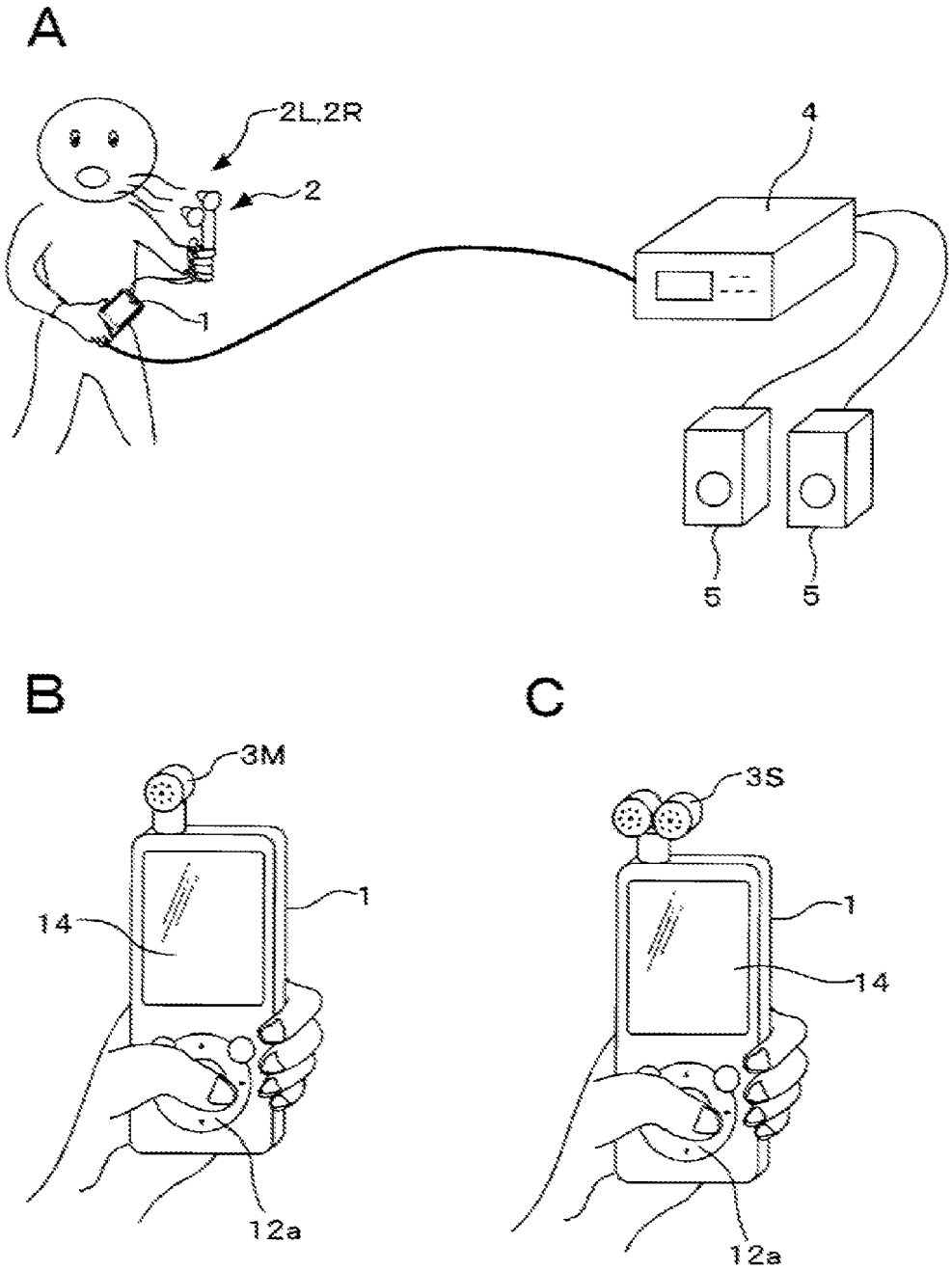
FIG. 2A is a view illustrating an audio player which is used to implement a karaoke system according to an exemplary embodiment of the present disclosure.
FIG. 2B is a view illustrating the audio player of FIG. 2A with a mono microphone according to an exemplary embodiment of the present disclosure.
FIG. 2C is a view illustrating the audio player of FIG. 2A with a stereo microphone according to an exemplary embodiment of the present disclosure.

The external communication unit 15 establishes communication with external devices, such as the amplifier 4 of FIG. 2, the monitor 6 or the cradle 7 of FIG. 3, in wired or wireless manner. The output signals SsL, SsR output from the DSP 16 may be transmitted to external devices through the external communication unit 15. That is, the external communication unit 15 outputs the output signals SsL, SsR from the DSP 16 to external speakers as output voice signals.

The operating unit 12 and the display unit 14 are provided for user interface. The operating unit 12 detects, for example, the user's operation on the operating part 12*a* or the touch panel in FIG. 1 and supplies the operation information to the control unit 11. The display unit 14 includes a liquid crystal panel or an organic electroluminescence (EL) panel and displays a variety of information under the control of the display controller 13. For example, the display unit 14 is configured to display replay operations, replayed music content, or messages.

The control unit 11 includes a microcomputer (CPU: central processing unit) and controls each component according to programs and the user's operations on the operating unit 12 to output audio signals. Specifically, the control unit 11 controls the output of the digital audio signals DaL, DaR in the replay unit 10 or the processes of the DSP 16. Further, the control unit 11 instructs the display controller 13 to display operating information on the display unit 14 according to operating conditions. Further, the control unit 11 may establish communication with external devices through the external communication unit 14.

In particular, in the present embodiment, the control unit 11 may control the DSP 16 to be switched to the NC (noise cancel) mode or to the karaoke mode so that the DSP 16 may be operated accordingly. Specifically, the control unit 11 controls the combination unit 16*e* of the DSP 16 to perform the first combining process for the NC mode, or controls the combination unit 16*e* of the DSP 16 to perform the second combination process for the karaoke mode. This process will be described in detail.

The replay unit 10 may replay music content accompanied by lyrics data of the music content. In this case, the lyrics data is supplied to the display controller 13, and the display controller 13 controls the display unit 14 to display the lyrics data. Further, the display controller 13 may transmit the lyrics data as display data to external devices through the external communication unit 15. For example, in the embodiment as shown in FIG. 3, the display controller 13 may control the display 6D of the monitor 6 to display the lyrics data.

<3. Signal Processing in NC Mode and Karaoke Mode>

The audio player 1 thus configured may perform operations in the NC mode and the karaoke mode by the user's operation. Specifically, for example, if the user selects one of the modes through the operating unit 12, the control unit 11 controls the DSP 16 to perform the NC mode or the karaoke mode.

Figure 6:
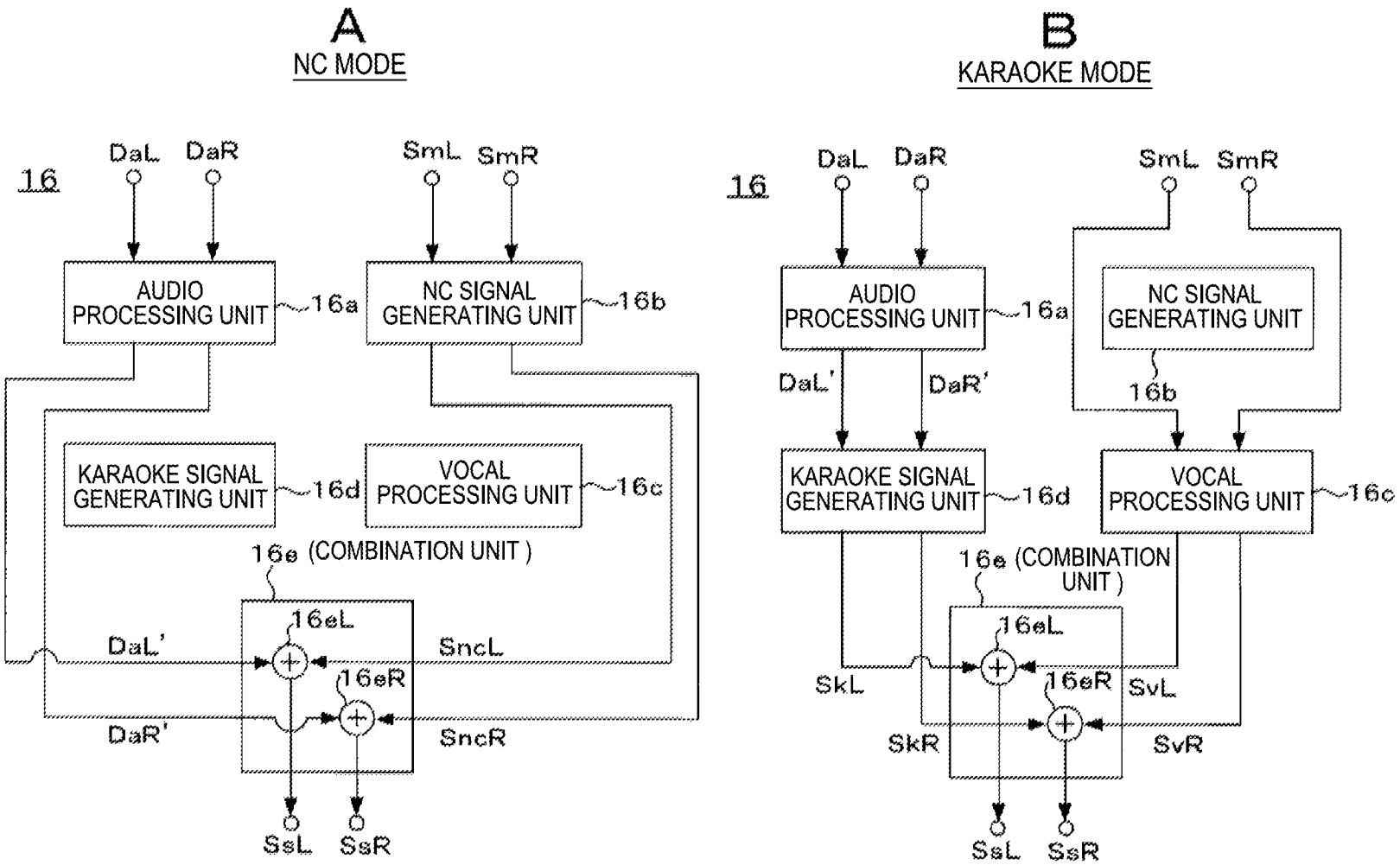
FIGS. 6A and 6B are views illustrating a digital signal processor (DSP) of an audio player for processing signals in a noise cancel (NC) mode and a karaoke mode, respectively, according to an exemplary embodiment of the present disclosure.

The process of the DSP 16 in each of the modes will be described with reference to FIG. 6. As described above, the DSP 16 serving as an operation processing device may perform operation processes with the audio processing unit 16*a*, the NC signal generating unit 16*b*, the vocal processing unit 16*c*, the karaoke signal generating unit 16*d*, and the combination unit 16*e* based on software programs. The operation processes are controlled by the control unit 11.

FIG. 6A illustrates a process flow of the DSP 16 when the control unit 11 instructs the DSP 16 to perform an operation in the NC mode. In this case, the audio processing unit 16*a*, the NC signal generating unit 16*b* and the combination unit 16*e* are executed. Specifically, the audio processing unit 16*a* performs equalizing process or gain adjusting process on the digital audio signals DaL, DaR which are supplied from the replay unit 10. After the process is completed, the audio processing unit 16*a* supplies the processed digital audio signal DaL' to an adder 16*e*L of the combination unit 16*e* and supplies the processed digital audio signal DaR' to an adder 16*e*R of the combination unit 16*e*.

The NC signal generating unit 16*b* generates noise cancel signals SncL, SncR based on the microphone input signals SmL, SmR from the microphone input unit 17. Next, the NC signal generating unit 16*b* supplies the noise cancel signal SncL based on the microphone input signal SmL to the adder 16*e*L of the combination unit 16*e* and supplies the noise cancel signal SncR based on the microphone input signal SmR to the adder 16*e*R of the combination unit 16*e*.

The adder 16*e*L of the combination unit 16*e* adds the digital audio signal DaL' and the noise cancel signal SncL into an output signal SsL. Further, the adder 16*e*R of the combination unit 16*e* adds the digital audio signal DaR' and the noise cancel signal SncR into an output signal SsR.

For the NC mode thus processed by the DSP 16, the sound of music content replayed by the replay unit 10 is output from the speakers 21L, 21R. As a result, the user may listen to the sound and, at the same time, may be provided with comfortable music with reduced noises.

FIG. 6B illustrates a process flow of the DSP 16 when the control unit 11 instructs the DSP 16 to perform an operation in the karaoke mode. In this case, the audio processing unit 16*a*, the karaoke signal generating unit 16*d*, the vocal processing unit 16*c* and the combination unit 16*e* are executed. Specifically, the audio processing unit 16*a* performs equalizing process or gain adjusting process on the digital audio signals DaL, DaR which are supplied from the replay unit 10. After the process is completed, the audio processing unit 16*a* supplies the processed digital audio signals DaL', DaR' to the karaoke signal generating unit 16*d*. The karaoke signal generating unit 16*d* performs, for example, vocal cancel process to generate karaoke signals SkL, SkR (signals with no or less vocal level). Next, the karaoke signal generating unit 16*d* supplies the L- and R-channel karaoke signals SkL, SkR to the adders 16*e*L, 16*e*R of the combination unit 16*e*.

The vocal processing unit 16*c* performs a sound process on the microphone input signals SmL, SmR from the microphone input unit 17 to be suitable for vocals. After the sound process is completed, the vocal processing unit 16*c* supplies the processed L- and R-channel signals (vocal signals SvL, SvR) to the adders 16*e*L, 16*e*R of the combination unit 16*e*.

The adder 16*e*L of the combination unit 16*e* adds the L-channel karaoke signal SkL and the vocal signal SvL into an output signal SsL. Further, the adder 16*e*R of the combination unit 16*e* adds the R-channel karaoke signal SkR and the vocal signal SvR into an output signal SsR.

For the karaoke mode thus processed by the DSP 16, the karaoke sound from the music content replayed by the replay unit 10 from which the vocal voice is removed is output from the speakers 21L, 21R and, at the same time, the voice of the singing user is output as the vocal voice from the speakers 21L, 21R. In other words, the karaoke operation is performed as illustrated in FIG. 4. Further, by transmitting the output signals SsL, SsR from the DSP 16 to the external devices through the external communication unit 15, the karaoke operation is performed as shown in FIG. 2 or 3. In this case, the microphones 3M, 3S may be connected to the audio player 1 as shown in FIG. 2B or 2C. In this case, the microphone input signals SmL, SmR input from the microphone input unit 17 to the DSP 16 may be voice signals collected by the microphones 3M, 3S.

As described above, the audio player 1 may be configured to switch from the music replay mode to the karaoke mode or vice versa by only changing the signal process in the DSP 16. The user may simply perform a mode select operation to select the music replay mode or the karaoke mode and enjoy music or karaoke. For the karaoke mode, the user may enjoy the karaoke most conveniently in the embodiment of FIG. 4 where the microphones 22L, 22R are used as vocal microphones in the earphone device 2 equipped with the NC function. Further, when the audio player 1 is configured to be connected to the external device or to use other microphones as shown in FIG. 2 or 3, the user may enjoy the karaoke more satisfactorily. In addition, if the microphones 22L, 22R with noise cancel function are used, the audio player 1 may be used for a duet.

<4. Processing Examples of DSP>

Figure 7:
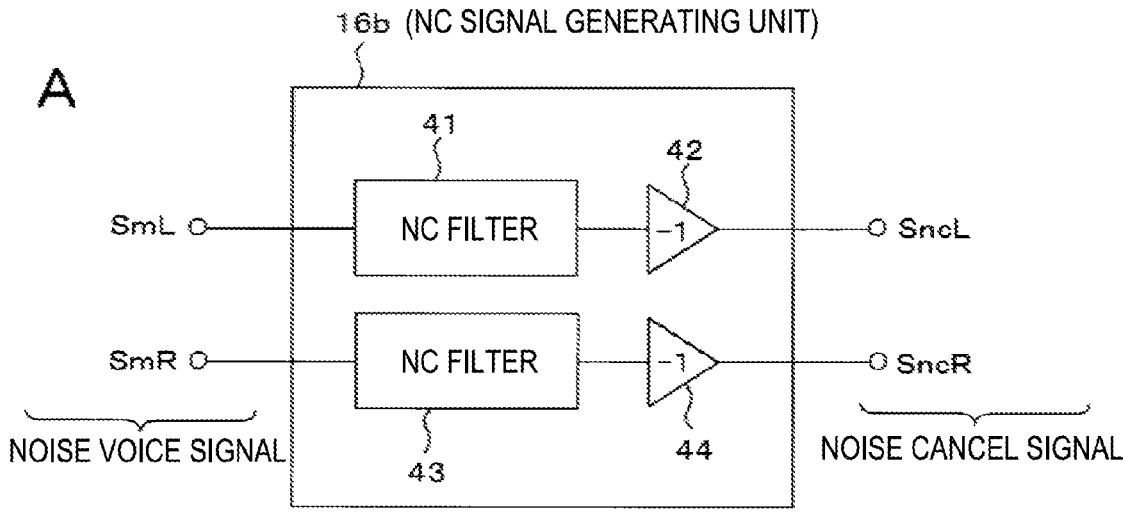
FIGS. 7A and 7B are views illustrating an NC signal generating unit and a vocal processing unit in an audio player, respectively, according to an exemplary embodiment of the present disclosure.
Figure 7:
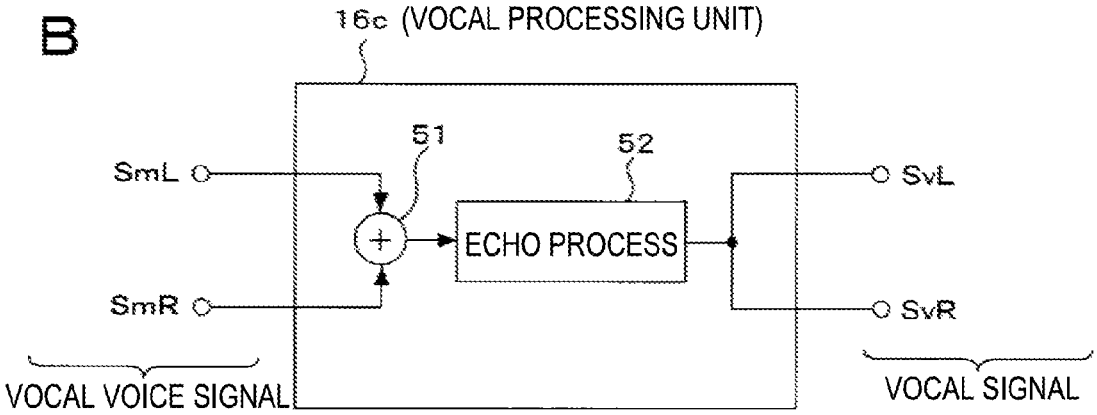

Processing examples of the DSP 16 will be described in detail. FIG. 7A illustrates a processing example of the NC signal generating unit 16*b*. The NC signal generating unit 16*b* generates the noise cancel signals SncL, SncR in the NC mode where the user typically listens to music from the audio player 1. The microphone input signals SmL, SmR become voice signals of external noise voices that are obtained through the microphones 22L, 22R.

The NC signal generating unit 16*b* includes NC filters 41, 43 and inverting amplifiers 42, 44. The NC filters 41, 43 are configured to function as, for example, high-rejection filters. The NC signal generating unit 16*b* generates the noise cancel signals SncL, SncR by using the NC filters 41, 43 to filter the microphone input signals SmL, SmR, respectively, and using the inverting amplifiers 42, 44 to invert the phases of the filtered signals. By adding the noise cancel signals SncL, SncR to the digital audio signals DaL', DaR', the user equipped with the earphone device 2 may be provided with music with less noise, i.e., with external noise spatially erased.

FIG. 7B illustrates a processing example of the vocal processing unit 16*c*. The vocal processing unit 16*c* generates the vocal signals SvL, SvR when the audio player 1 is operated in the karaoke mode. The microphone input signals SmL, SmR become voice signals of the voice of the singing user which are obtained through the microphones 22L, 22R or the other microphones 3M, 3S.

The vocal processing unit 16*c* includes an adder 51 and an echo processor 52. Specifically, the vocal processing unit 16*c* is configured to use the adder 51 to add the microphone input signals SmL, SmR and to use the echo processor 52 to perform echo process on the added signals. After the echo process is completed, the vocal processing unit 16*c* divides the echo-processed signals into L- and R-channel vocal signals SvL, SvR. By the echo process thus performed by the vocal processing unit 16*c*, it is possible to output a vocal sound which is the singing voice with the echoing effect. In the present embodiment, the addition of L- and R-channels is followed by the echo process. However, it should be understood that the echo process may be individually performed on the microphone input signals SmL, SmR.

Figure 8:
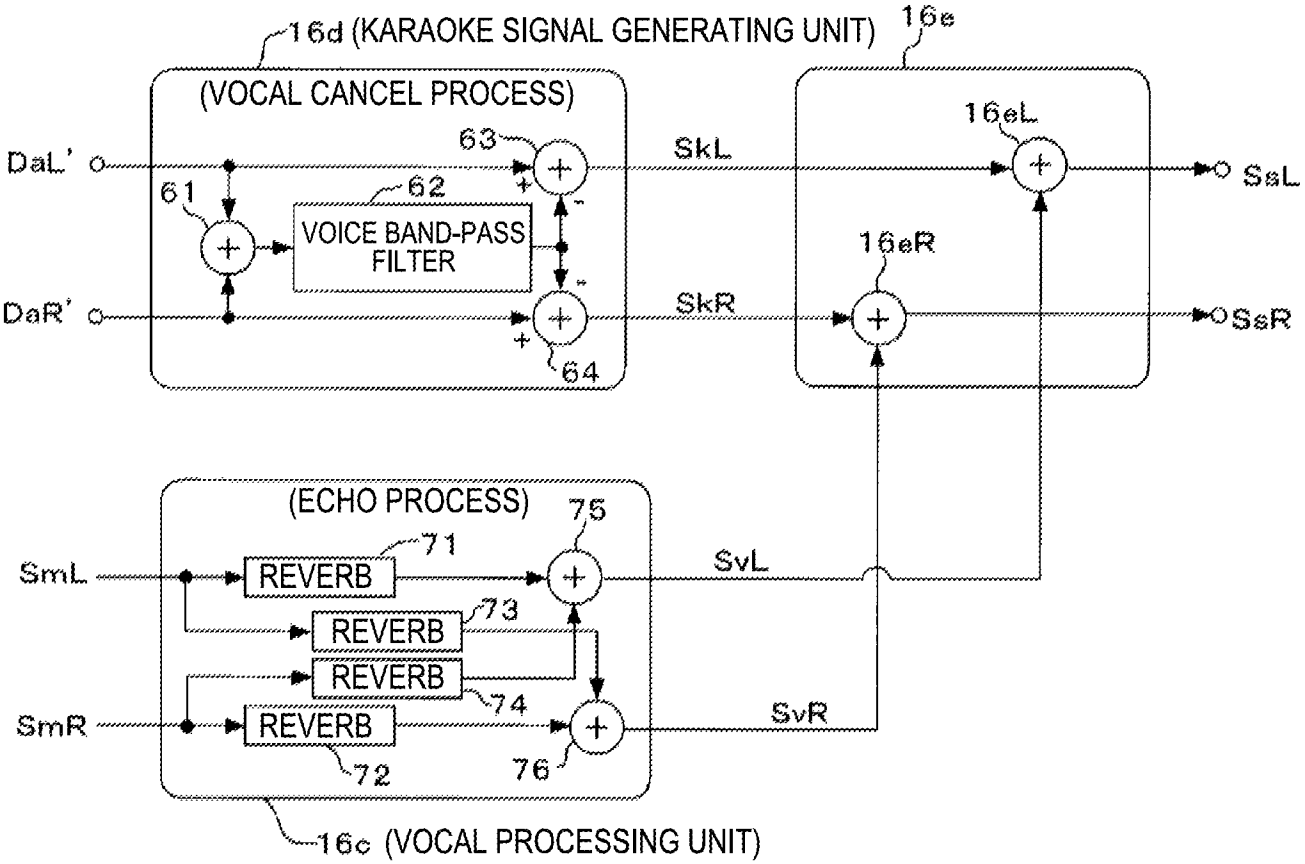
FIG. 8 is a view illustrating a DSP process according to an exemplary embodiment of the present disclosure.

FIG. 8 illustrates processes of the karaoke signal generating unit 16*d* and the vocal processing unit 16*c* in the karaoke mode. The karaoke signal generating unit 16*d* performs a vocal cancel process through an adder 61, a voice band-pass filter 62, and subtractors 63, 64. The digital audio signals DaL', DaR' are added by the adder 61 and supplied to the voice band-pass filter 62. The voice band-pass filter 62 passes a voice band (e.g., 300 Hz~3 kHz). Signal components of the voice band are supplied to the subtractors 63, 64. The subtractor 63 subtracts a voice band of signal component from the digital audio signal DaL'. The subtractor 64 subtracts a voice band of signal component from the digital audio signal DaR'. As such, the karaoke signals SkL, SkR with reduced vocal voices are generated from the digital audio signals DaL', DaR' of the music content.

The vocal processing unit 16*c* performs an echo process. In this embodiment, the vocal processing unit 16*c* includes reverb processors 71-74 and adders 75, 76. Specifically, the microphone input signal SmL with an echoing component added by the reverb processor 71 is supplied to the adder 75 and, at the same time, an echoing component generated by the reverb processor 73 is supplied to the adder 76. The microphone input signal SmR with an echoing component added by the reverb processor 72 is supplied to the adder 76 and, at the same time, an echoing component generated by the reverb processor 74 is supplied to the adder 75. The adder 75 adds the microphone input signal SmL with the added echo component and the echo component of the microphone input signal SmR into the L-channel vocal signal SvL. The adder 76 adds the microphone input signal SmR with the added echo component and the echo component of the microphone input signal SmL into the R-channel vocal signal SvR.

The adders 16*e*L, 16*e*R of the combination unit 16*e* adds the karaoke signals SkL, SkR and the vocal signals SvL, SvR into the output signals SsL, SsR of the DSP 16. As such, the user may enjoy the karaoke sound accompanied by the user's singing voice with rich reverb added.

Figure 9:
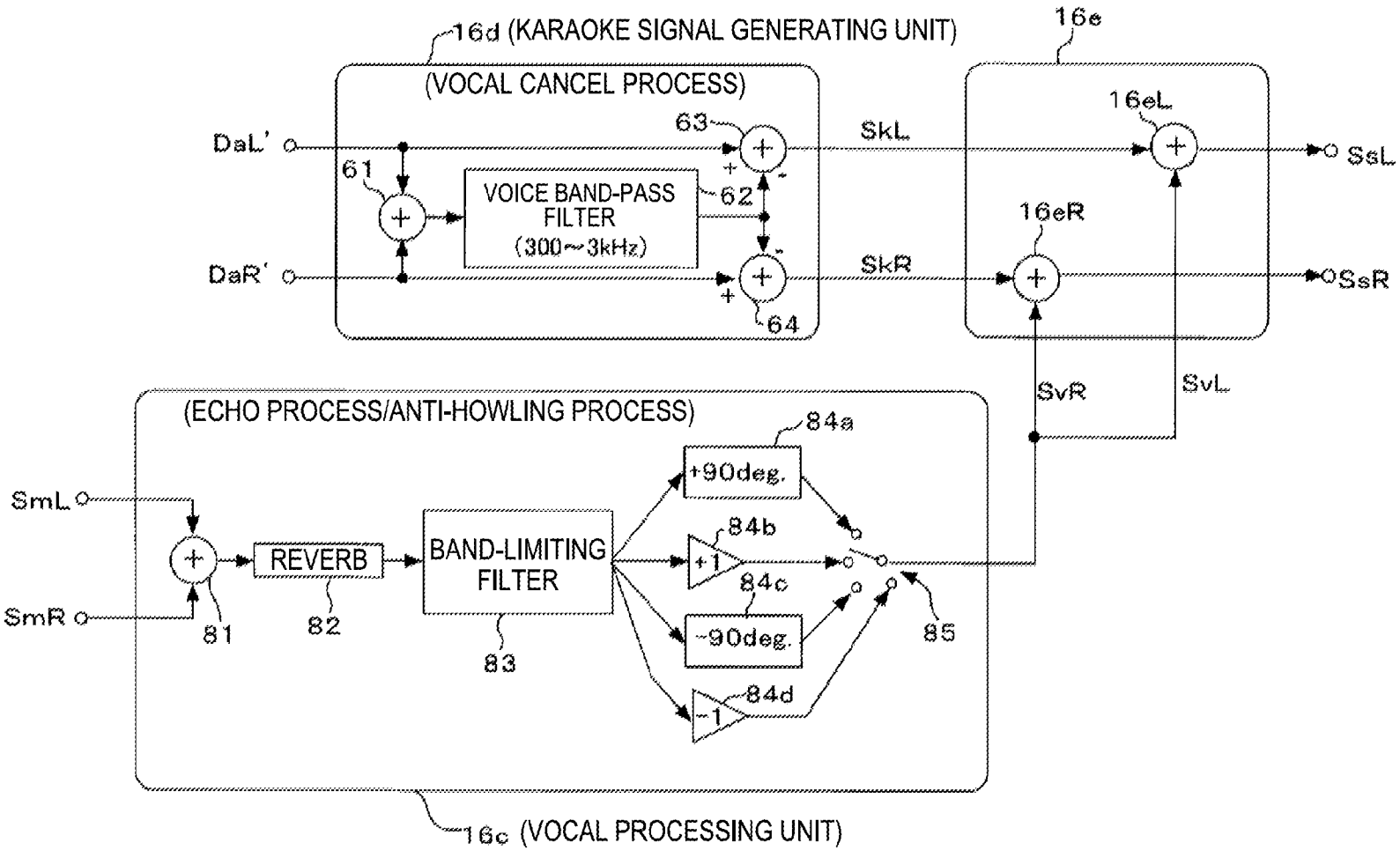
FIG. 9 is a view illustrating a DSP process according to an exemplary embodiment of the present disclosure.

FIG. 9 also illustrates processes of the karaoke signal generating unit 16*d* and the vocal processing unit 16*c* in the karaoke mode. The karaoke signal generating unit 16*d* performs the same process as that shown in FIG. 8. The present embodiment illustrates the vocal processing unit 16*c* that performs an anti-howling process in addition to the echo (reverb) process.

The vocal processing unit 16*c* includes an adder 81, a reverb processor 82, a band-limiting filter 83, phase shifters 84*a*-84*d*, and a selector 85. The vocal processing unit 16*c* controls the adder 81 to add the microphone input signals SmL, SmR and controls the reverb processor 82 to add an echoing component to the added signals. The signal from the reverb processor 82 is limited by the band-limiting filter 83. For example, the band-limiting filter 83 passes a voice band (i.e., 300 Hz~3 kHz). The signal of the voice band is supplied to the phase shifters 84-84*d*.

The phase shifters 84*a*-84*d* shift phases of the input signal by +90°, 0°, −90° and 180°, respectively. Actually, the phase shifter 84*b* shifting a phase of 0° may be implemented by a non-inverting amplifier with a gain of 1, and the phase shifter 84*d* shifting a phase of 180° may be implemented by an inverting amplifier with a gain of 1. Further, the phase shifters 84*a*, 84*c* shifting phases of +90° and −90°, respectively, may be implemented by Hilbert transform filters. The selector 85 selects the output of any one of the phase shifters 84*a*-84*d*, divides the selected output into the L- and R-channel vocal signals SvL, SvR, and supplies the L- and R-channel vocal signals SvL, SvR to the adders 16*e*L, 16*e*R of the combination unit 16*e*, respectively. The selection of the selector 85 is changed according to the user's operation. The combination unit 16*e* adds the vocal signals SvL, SvR and the karaoke signals SkL, SkR, respectively, into the output signals SsL, SsR.

The process performed as shown in FIG. 9 may suppress the howling. For example, if a user as a singer recognizes a howling sound, the user may operate the operating unit 12 of the audio player 1 to select a phase-shift mode. That is, the selection of the selector 85 is randomly changed. By finding the selection condition to remove the howling and changing the phases of the vocal signals SvL, SvR, it is possible to make it difficult for the howling to occur.

Figure 10:
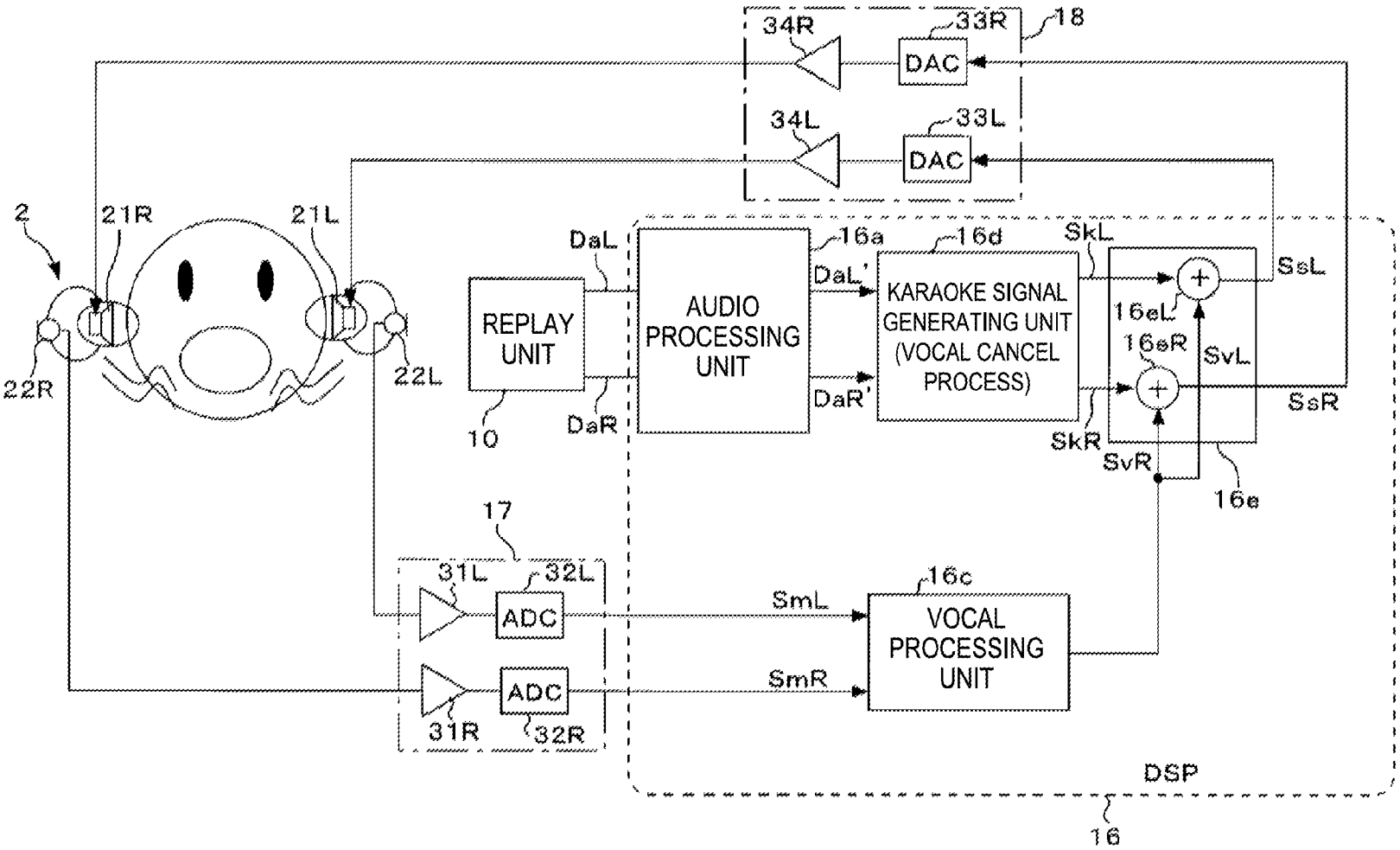
FIG. 10 is a view illustrating a signal process in operating in karaoke mode with an earphone mounted according to an exemplary embodiment of the present disclosure.
Figure 11:
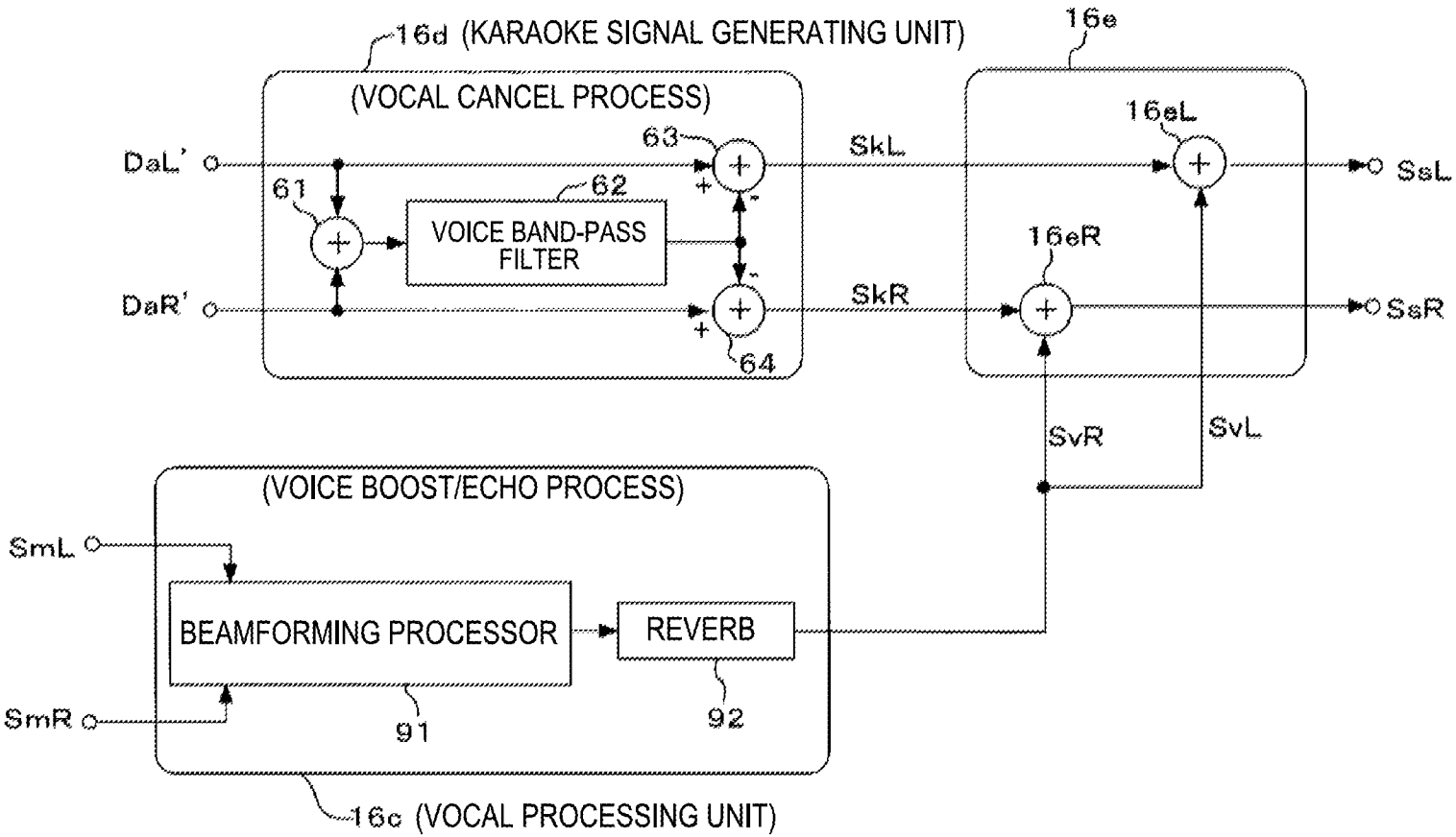
FIG. 11 is a view illustrating a DSP process in operating in karaoke mode with an earphone mounted according to an exemplary embodiment of the present disclosure.

FIGS. 10 and 11 illustrate a process of the DSP 16 which is very suitable for a user to enjoy karaoke in a self-contained manner using the earphone device 2 as illustrated in FIG. 4. Assuming that the user wears the earphone device 2 to use the microphones 22L, 22R as vocal microphones and listen to vocal and karaoke sound through the speakers 21L, 21R as described with reference to FIG. 4, the signal flow is shown in FIG. 10.

The digital audio signals DaL, DaR of music content replayed by the replay unit 10 are processed by the audio processing unit 16*a* and the karaoke signal generating unit 16*d* in the DSP 16 into the karaoke signals SkL, SkR. The karaoke signals SkL, SkR are then supplied to the combination unit 16*e*. The user's singing voice is collected by the microphones 22L, 22R and is input as the microphone input signals SmL, SmR to the DSP 16 through the microphone input unit 17. The vocal processing unit 16*c* performs the following beamforming process on the microphone input signals SmL, SmR to generate the vocal signals SvL, SvR. The vocal signals SvL, SvR are then supplied to the combination unit 16*e*. The combination unit 16*e* adds the vocal signals SvL, SvR and the karaoke signals SkL, SkR, respectively, into the output signals SsL, SsR. The output signals SsL, SsR are converted into analog signals and power-up amplified by the earphone output unit 18 and presented to the user as a combination of the karaoke sound and the singing voice through the speakers 21L, 21R.

FIG. 11 illustrates processes of the vocal processing unit 16*c* and the karaoke signal generating unit 16*d* in the DSP 16 which are suitable for the forgoing situation. The karaoke signal generating unit 16*d* performs the same vocal cancel process as that shown in FIG. 8. In this embodiment, the vocal processing unit 16*c* includes a beamforming processor 91 and a reverb processor 92. In this case, since the user wears the earphone device 2, the microphones 22L, 22R are placed near the user's ears rather than the user's mouth. In this case, a singer's voice may be certainly collected by performing the beamforming process. In other words, the beamforming technique enables the sound to be collected with directivity.

In this case, two microphones (stereo microphones) are generally used. If forward or backward directivity is desired, the simplest beamforming process may be performed by the addition of voice signals from left and right microphones. In this case, since left- and right-channel voice signal components of voice from a sound source located at equal distances from the microphones are in phase, they are boosted by the addition of the voice signal components. However, since voice signal components of voice from a sound source at a different direction are out of phase, they are reduced by that much. As such, for example, a voice signal with a forward directivity may be obtained. The two microphones 22L, 22R installed in the speaker units 2L, 2R of the earphone device 2 are located at almost equal distances from the user's mouth. Accordingly, only by the addition of the left and right microphone input signals SmL, SmR of the beamforming processor 91, it is possible to extract the user's singing voice despite noises. That is, the beamforming process enables the user's singing voice to be correctly collected with directivity and the noises to be reduced at the same time. Further, the beamforming may be focused in directions other than the forward direction. In this case, by providing a delay device on one channel, it is possible to absorb the time difference of equal wavefronts reaching the microphones. Hence, beamforming may be formed in inclined or transverse direction. Accordingly, delay processing may be performed depending upon a positional relation between the microphones 22L, 22R and the user's mouth when the user wears the earphone device 2.

Further, in order to obtain a more precise beamforming (in this case, a higher directivity of the microphones 22L, 22R to the user's mouth and a reduced noise), a noise suppression device using a band-pass filter may be used.

Figure 12:
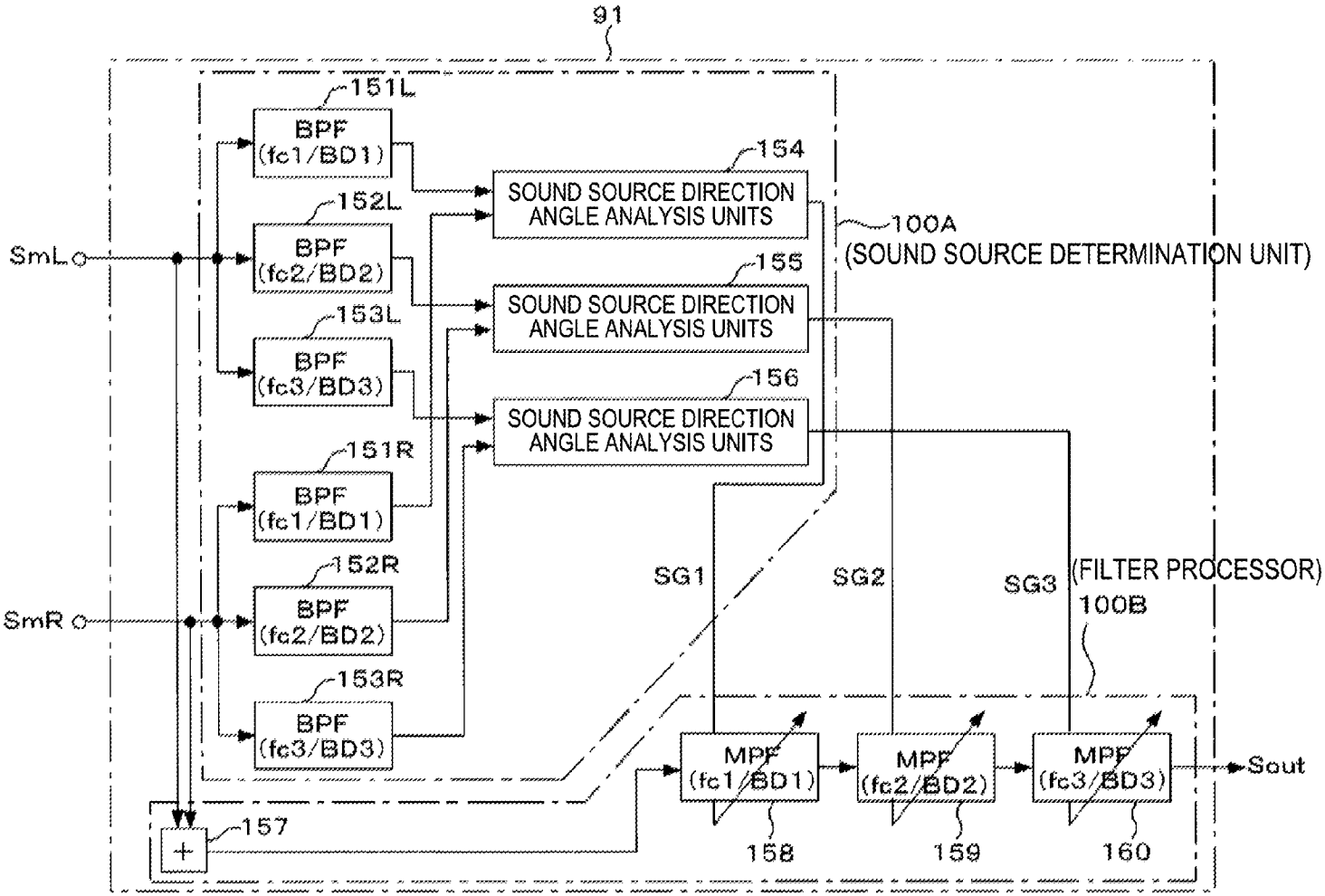
FIG. 12 is a block diagram illustrating a beamforming unit of a vocal processing unit according to an exemplary embodiment of the present disclosure.

FIG. 12 illustrates a structure (noise suppression processor) to be used as the beamforming processor 91 of FIG. 11. As shown in FIG. 12, the beamforming processor (noise suppression processor) 91 includes a sound source direction determination unit 100A and a filter processor 100B. In this embodiment, the sound source direction determination unit 100A determines sound source directions at each of the first to third bands for the L/R channel microphone input signals SmL, SmR. The filter processor 100B includes three series-connected filters (MPFs: mid presence filters) 158, 159, 160 to boost or attenuate the voice signals at the first to third bands.

The sound source determination unit 100A includes band-pass filters 151L, 152L, 153L, 151R, 152R, 153R and sound source direction angle analysis units 154, 155, 156. The band-pass filters 151L, 152L, 153L have central pass frequencies fc1, fc2, fc3, respectively. For convenience, the pass bands are denoted by BD1, BD2, BD3, respectively. The band-pass filters 151R, 152R, 153R have central pass frequencies fc1, fc2, fc3, respectively. Likewise, the pass bands are denoted by BD1, BD2, BD3, respectively. The left-channel microphone input signal SmL is input to the band-pass filters 151L, 152L, 153L, thereby extracting voice signal components of the bands BD1, BD2, BD3. The right-channel microphone input signal SmR is input to the band-pass filters 151R, 152R, 153R, thereby extracting voice signal components of the bands BD1, BD2, BD3.

The voice signal components of the band BD1 of the left- and right-channels, which are the outputs of the band-pass filters 151L, 151R, are supplied to the sound source direction angle analysis unit 154. The voice signal components of the band BD2 of the left- and right-channels, which are the outputs of the band-pass filters 152L, 152R, are supplied to the sound source direction angle analysis unit 155. The voice signal components of the band BD3 of the left- and right-channels, which are the outputs of the band-pass filters 153L, 153R, are supplied to the sound source direction angle analysis unit 156.

The sound source direction angle analysis unit 154 determines a sound source direction of a dominant sound among the voice signal components of the band BD1. The sound source direction angle analysis unit 155 determines a sound source direction of a dominant sound among the voice signal components of the band BD2. The sound source direction angle analysis unit 156 determines a sound source direction of a dominant sound among the voice signal components of the band BD3. Each of the sound source direction angle analysis units 154, 155, 156 determines the sound source direction at its corresponding band based on the energy difference of voice signals on each channel. The sound source direction angle analysis units 154, 155, 156 control the MPFs 158, 159, 160, which correspond one-to-one to each other by the control signals SG1, SG2, SG3, respectively, according to the determined directions. As can be seen from FIG. 12, the sound source direction angle analysis unit 154 controls the MPF 158; the sound source direction angle analysis unit 155 controls the MPF 159; and the sound source direction angle analysis unit 156 controls the MPF 160.

The filter processor 100B includes an adder 157 and MPFs 158, 159, 160. The MPFs 158, 159, 160 are a group of series-connected filters. The adder 157 adds the left- and right-channel microphone input signals SmL, SmR. The voice signal (LR added signal), which is a combination of the left- and right-channel microphone input signals that are added by the adder 157, is supplied to the MPF 158.

Figure 13:
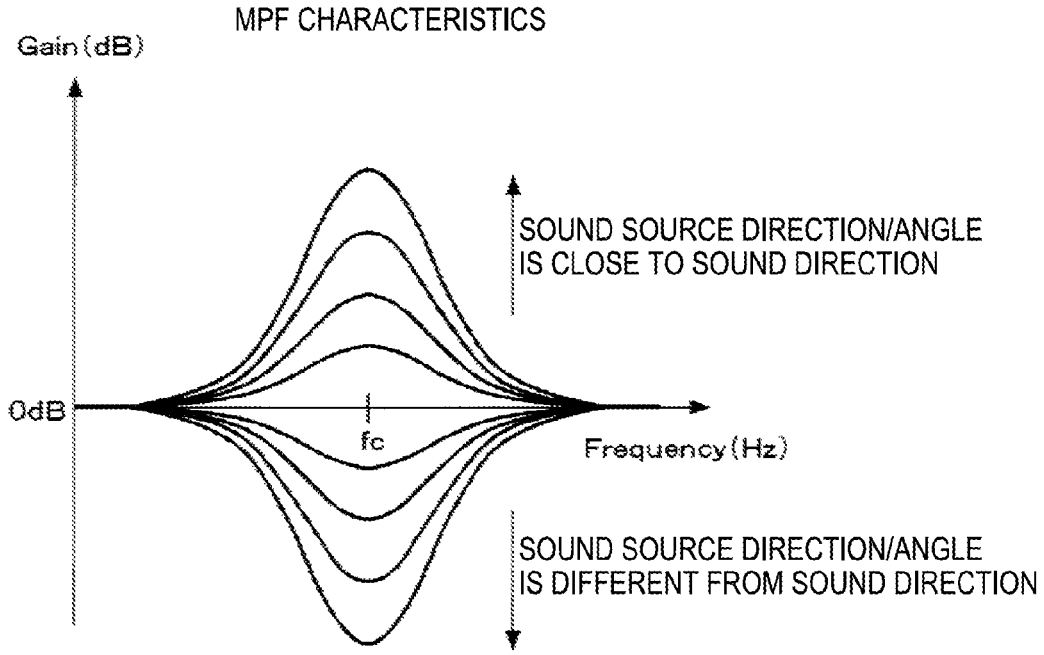
FIG. 13 is a view illustrating mid-presence filter (MPF) characteristics of a beamforming unit according to an exemplary embodiment of the present disclosure.

The MPFs 158, 159, 160 boost or attenuate their corresponding bands. Here, the three MPFs are provided since the band-pass filters 151L, 152L, 153L, 151R, 152R, 153R of the sound source direction determination unit 100A divide the microphone input signals SmL, SmR into three bands. The MPFs 158, 159, 160 have central frequencies fc1, fc2, fc3, respectively. Each of the MPFs 158, 159, 160 has filter characteristics shown in FIG. 13. Each of the MPFs 158, 159, 160 is configured to amplify or reduce the gain with respect to a band of interest (a band with a central frequency of fc). As described above, the boost or attenuation of the band of interest by the gain adjustment, which is performed in the MPFs 158, 159, 160, is controlled by the sound source direction angle analysis units 154, 155, 156.

Specifically, while the MPF 158 boosts or attenuates the band BD1 with a central frequency of fc1, the MPF 158 corresponds to the band-pass filters 151L, 151R and the sound source direction angle analysis unit 154. Further, while the MPF 159 boosts or attenuates the band BD2 with a central frequency of fc2, the MPF 159 corresponds to the band-pass filters 152L, 152R and the sound source direction angle analysis unit 155. Further, while the MPF 160 boosts or attenuates the band BD3 with a central frequency of fc3, the MPF 160 corresponds to the band-pass filters 153L, 153R and the sound source direction angle analysis unit 156.

If beamforming is performed towards the user's mouth when seen from the microphones 22L, 22R, a band where the direction of a sound source is determined as a target direction is boosted, while a band where the direction of a sound source is determined as a different direction than the target direction is attenuated. The level of boost or attenuation varies depending upon the determination of direction angle.

The MPFs 158, 159, 160 boost or attenuate the added microphone input signals SmL, SmR under the control of the sound source direction angle analysis units 154, 155, 156. The output of the MPF 160 becomes the output signal Sout of the beamforming processor 91. As a result, the output of the beamforming processor 91 is a signal which is obtained by correctly collecting the user's singing voice (the sound around the user's mouth) with reduced noises.

As shown in FIG. 11, the echoing component is added by the reverb processor 92 to the output signal of the beamforming processor 91. The output of the reverb processor 92 is divided into the L- and R-channel vocal signals SvL, SvR, which are supplied to the adders 16*e*L, 16*e*R of the combination unit 16*e*. The combination unit 16*e* adds the vocal signals SvL, SvR and the karaoke signals SkL, SkR, respectively, into the output signals SsL, SsR. Accordingly, by the forgoing processes, it is possible to provide the user with high quality karaoke and vocal sound when the user enjoys karaoke in a self-contained manner.

<Modified Examples>

Figure 14:
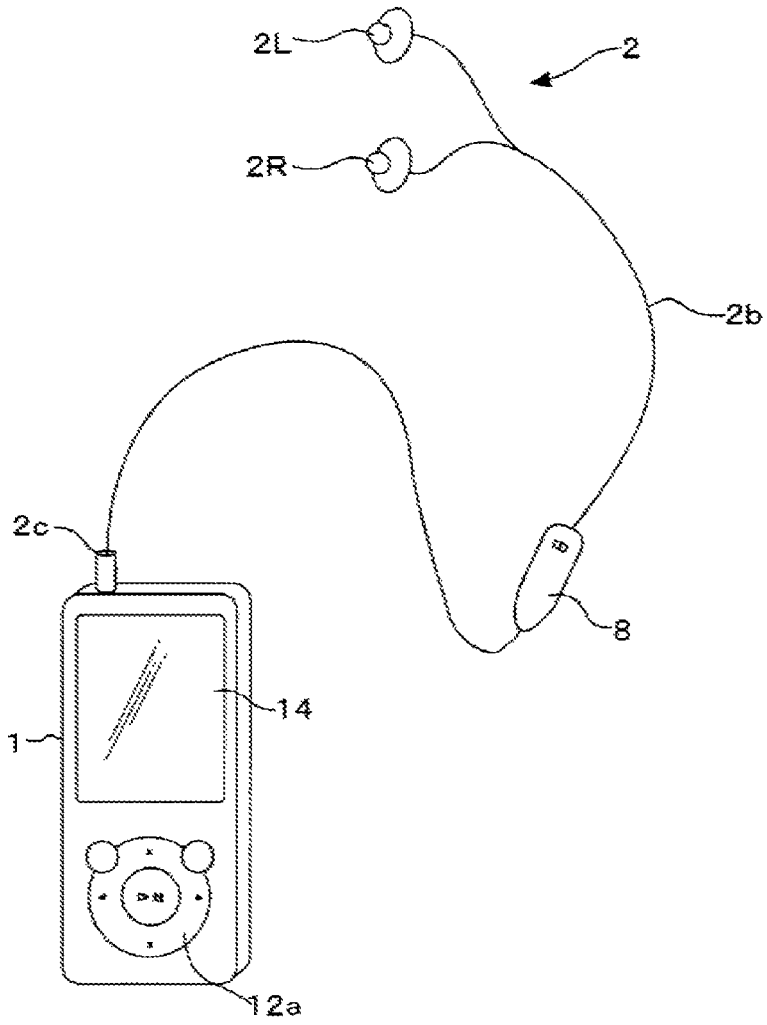
FIG. 14 is a view illustrating a noise cancel unit according to an exemplary embodiment of the present disclosure.

Although preferred embodiments of the present disclosure are described in detail with reference to the appended drawings, the present technology is not limited thereto. It should be understood that various modifications may be provided. In the preferred embodiments, the microphone input unit 17, the DSP 16, the earphone output unit 18, and the control unit 11 (the control unit 11 configured to control the DSP 16) are installed in the audio player 1 to perform the NC mode and the karaoke mode. On the other hand, as shown in FIG. 14, a noise cancel unit 8 may be provided separately from the audio player 1 and, for example, installed in the middle of the earphone device 2. In this case, the noise cancel unit 8 may be configured as a signal processing device which includes elements corresponding to the microphone input unit 17, the DSP 16, the earphone output unit 18 and the control unit 11 (the control unit 11 configured to control the DSP 16) so that the user may selectively enjoy the music and the karaoke. In other words, a signal processing device configured to implement the NC mode and the karaoke mode may be provided separately from a replay apparatus, such as the audio player 1.

Further, in the preferred embodiments, the microphones 22L, 22R (or other microphones) may be used for a duet. In this case, the vocal processing unit 16*c* may be configured to individually perform such a sound process as an echo process on each of the microphone input signals SmL, SmR.

The vocal processing unit 16*c* may be configured to perform other sound processes, such as vocal boost process, voice change process, harmony adding process, or vocal level adjustment, than the forgoing sound processes. Examples of the vocal boost process may include equalization for boosting vocal bands or addition of harmonics components to vocal components. An example of the voice change process may include changing frequency characteristics of signals. An example of the harmony adding process may include operations of extracting a vocal signal, pitch-shifting the extracted vocal signal, and adding the shifted vocal signal to the vocal signal.

In addition, the karaoke signal generating unit 16*d* may be configured to perform key adjustment (pitch shift). Specifically, by performing pitch shift on a karaoke signal of music, a user may adjust a key of the music to his/her desired key.

Further, when the output signals SsL, SsR of the DSP 16 are transmitted to an external device through the external communication unit 15, the output signals may be recorded on a recording device without outputting the output signals from speakers of the external device.

Further, digital microphones may be used as the microphones 3M, 3S or the microphones 22L, 22R. In this case, the microphone input unit 17 may not include the microphone amplifiers 32L, 32R and the A/D converters 31L, 31R. Accordingly, the microphone input unit 17 may be configured as an input interface from the digital microphones, or the DSP 16 may be configured to be equipped with the function of the microphone input unit 17.

Additionally, the present technology may also be configured as below.

(1) A replay apparatus including:

a music source unit configured to output a digital audio signal of music;

a microphone signal input unit configured to input a voice signal supplied from a microphone;

a noise cancel signal generating unit configured to generate a noise cancel signal having a signal characteristic to cancel an external noise component based on the voice signal input by the microphone signal input unit;

a vocal processing unit configured to perform a sound process for vocal voice on the voice signal input by the microphone signal input unit to generate a vocal signal;

a karaoke signal generating unit configured to generate a karaoke signal by canceling a vocal voice component from the digital audio signal supplied from the music source unit;

a combination unit configured to perform a first combining process where the digital audio signal supplied from the music source unit and the noise cancel signal are combined, and a second combining process where the karaoke signal and the vocal signal are combined;

a control unit configured to control the combination unit to perform the first combining process in a first mode and to perform the second combining process in a second mode; and an output unit configured to output the combined signals combined by the combination unit as a voice signal to be output from a speaker.

(2) The replay apparatus according to (1), wherein the noise cancel signal generating unit, the vocal processing unit, the karaoke signal generating unit and the combination unit are installed as software processing functions in an operation processing device, and wherein the control unit controls the operation processing device to execute the noise cancel signal generating unit and to execute the combination unit to perform the first combining process in the first mode, and the control unit controls the operation processing device to execute the vocal processing unit and the karaoke signal generating unit and to execute the combination unit to perform the second combining process in the second mode.

(3) The replay apparatus according to (1) or (2), wherein the vocal processing unit performs a beamforming process for the sound process for vocal voice.

(4) The replay apparatus according to any one of (1) to (3), wherein the vocal processing unit performs a reverb process for the sound process for vocal voice.

(5) The replay apparatus according to any one of (1) to (4), wherein the vocal processing unit performs an anti-howling process for the sound process for vocal voice.

(6) The replay apparatus according to any one of (1) to (5), wherein the karaoke signal generating unit generates a karaoke signal with no vocal voice component by extracting the vocal voice component from the digital audio signal supplied from the music source unit and subtracting the vocal voice component from the digital audio signal.

(7) The replay apparatus according to any one of (1) to (6), wherein the microphone signal input unit is configured to input a voice signal supplied from a microphone installed in a case of a connected earphone.

(8) The replay apparatus according to any one of (1) to (7), further including a display control unit outputting, as display data, lyrics data corresponding to the digital audio signal output from the music source unit.

Although preferred embodiments of the present disclosure are described in detail with reference to the appended drawings, the present technology is not limited thereto. It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-125949 filed in the Japan Patent Office on Jun. 06, 2011, the entire content of which is hereby incorporated by reference.

What is claimed is:

1. A replay apparatus comprising:

a music source unit configured to output a digital audio signal of music;

a microphone signal input unit configured to input a voice signal supplied from a microphone;

a noise cancel signal generating unit configured to generate a noise cancel signal having a signal characteristic to cancel an external noise component based on the voice signal input by the microphone signal input unit;

a vocal processing unit configured to perform a sound process for vocal voice on the voice signal input by the microphone signal input unit to generate a vocal signal;

a karaoke signal generating unit configured to generate a karaoke signal by canceling a vocal voice component from the digital audio signal supplied from the music source unit;

a combination unit configured to perform a first combining process where the digital audio signal supplied from the music source unit and the noise cancel signal are combined, and a second combining process where the karaoke signal and the vocal signal are combined;

a control unit configured to control the combination unit to perform the first combining process in a first mode and to perform the second combining process in a second mode; and an output unit configured to output the combined signals combined by the combination unit as a voice signal to be output from a speaker.

2. The replay apparatus according to claim 1, wherein the noise cancel signal generating unit, the vocal processing unit, the karaoke signal generating unit and the combination unit are installed as software processing functions in an operation processing device, and wherein the control unit controls the operation processing device to execute the noise cancel signal generating unit and to execute the combination unit to perform the first combining process in the first mode, and the control unit controls the operation processing device to execute the vocal processing unit and the karaoke signal generating unit and to execute the combination unit to perform the second combining process in the second mode.

3. The replay apparatus according to claim 1, wherein the vocal processing unit performs a beamforming process for the sound process for vocal voice.

4. The replay apparatus according to claim 1, wherein the vocal processing unit performs a reverb process for the sound process for vocal voice.

5. The replay apparatus according to claim 1, wherein the vocal processing unit performs an anti-howling process for the sound process for vocal voice.

6. The replay apparatus according to claim 1, wherein the karaoke signal generating unit generates a karaoke signal with no vocal voice component by extracting the vocal voice component from the digital audio signal supplied from the music source unit and subtracting the vocal voice component from the digital audio signal.

7. The replay apparatus according to claim 1, wherein the microphone signal input unit is configured to input a voice signal supplied from a microphone installed in a case of a connected earphone.

8. The replay apparatus according to claim 1, further comprising a display control unit outputting, as display data, lyrics data corresponding to the digital audio signal output from the music source unit.

9. A signal processing apparatus comprising:

a microphone signal input unit configured to input a voice signal supplied from a microphone;

a noise cancel signal generating unit configured to generate a noise cancel signal having a signal characteristic to cancel an external noise component based on the voice signal input by the microphone signal input unit;

a vocal processing unit configured to perform a sound process for vocal voice on the voice signal input by the microphone signal input unit to generate a vocal signal;

a karaoke signal generating unit configured to generate a karaoke signal by canceling a vocal voice component from the digital audio signal of input music;

a combination unit configured to perform a first combining process where the input digital audio signal and the noise cancel signal are combined, and a second combining process where the karaoke signal and the vocal signal are combined;

a control unit configured to control the combination unit to perform the first combining process in a first mode and to perform the second combining process in a second mode; and an output unit configured to output the combined signals combined by the combination unit as a voice signal to be output from a speaker.

10. A method of selectively performing signal processing in a first mode and in a second mode, wherein in the first mode, a noise cancel signal having a signal characteristic to cancel an external noise component is generated based on a voice signal supplied from a microphone, and an input digital audio signal and the noise cancel signal are combined into a voice signal to be output through a speaker; and in the second mode, a sound process for vocal voice is performed on a voice signal supplied from a microphone, a vocal voice component is canceled from a digital audio signal of input music to generate a karaoke signal, and the karaoke signal and the vocal signal are combined into a voice signal to be output through a speaker.

* * * * *